US006759999B1

(12) United States Patent
Doyen

(10) Patent No.: US 6,759,999 B1
(45) Date of Patent: Jul. 6, 2004

(54) METHOD OF ADDRESSING A PLASMA DISPLAY PANEL

(75) Inventor: Didier Doyen, La Bouexière (FR)

(73) Assignee: Thomson Licensing S.A., Boulogne-Billancourt (FR)

( * ) Notice: Subject to any disclaimer, the term of this patent is extended or adjusted under 35 U.S.C. 154(b) by 0 days.

(21) Appl. No.: 10/009,421

(22) PCT Filed: May 18, 2000

(86) PCT No.: PCT/EP00/04512

§ 371 (c)(1),
(2), (4) Date: Dec. 4, 2001

(87) PCT Pub. No.: WO00/75913

PCT Pub. Date: Dec. 14, 2000

(30) Foreign Application Priority Data

Jun. 4, 1999 (FR) ..... 99 07095

(51) Int. Cl.[7] ..... G09G 3/28; G09G 5/10

(52) U.S. Cl. ..... 345/63; 345/690; 345/692; 345/694

(58) Field of Search ..... 345/60–63, 68, 345/690, 692, 694, 695, 696

(56) References Cited

U.S. PATENT DOCUMENTS

| | | | | |
|---|---|---|---|---|
| 5,841,413 A | * | 11/1998 | Zhu et al. | 345/63 |
| 6,052,112 A | * | 4/2000 | Tanaka et al. | 345/596 |
| 6,424,325 B1 | * | 7/2002 | Van Dijk | 345/60 |
| 6,552,701 B1 | * | 4/2003 | Tanaka | 345/63 |
| 6,611,108 B2 | * | 8/2003 | Kimura | 315/169.3 |

FOREIGN PATENT DOCUMENTS

| | | | |
|---|---|---|---|
| EP | 811 963 A1 | 12/1997 | G09G/3/28 |
| EP | 837 441 A1 | 4/1998 | G09G/3/28 |
| EP | 874 349 A1 | 10/1998 | G09G/3/28 |

OTHER PUBLICATIONS

Search Report*.

* cited by examiner

*Primary Examiner*—Richard Hjerpe
*Assistant Examiner*—Duc Q. Dinh
(74) *Attorney, Agent, or Firm*—Joseph S. Tripoli; Harvey D. Fried; Sammy S. Henig

(57) ABSTRACT

The invention provides a novel scanning technique aimed at reducing the phenomenon of contouring. The scanning technique of the invention consists in adding at least one redundant subscan SP0 to SP4. The purpose of the redundant subscans SP0 to SP4 is to place an additional illumination time which is privileged. The redundant subscan SP0 to SP4 thus introduced makes it possible to have a steady illumination time virtually independent of the grey level and therefore to minimize the high-weight switching effects. The subject of the invention is a method of displaying a video image on a plasma display panel, in which, during the display period each of the cells is illuminated in total for a time of between zero and a maximum display time corresponding to the maximum brightness of a cell for a given brightness setting, single subscans SB1 to SB8 and redundant subscans SP0 to SP4 are carried out so that the cells are "on" or "off" during a period specific to each of the said subscans, and the sum of the periods specific to each of the single subscans SB1 to SB8 and of the period specific to the redundant subscans SP0 to SP4 is greater than the maximum display time of a cell.

9 Claims, 3 Drawing Sheets

| | | | | | | | | | | | | | |
|---|---|---|---|---|---|---|---|---|---|---|---|---|---|
| TC | SB1 | SB2 | SB3 | SB4 | SB5 | SP0 | SP1 | SP2 | SP3 | SP4 | SB6 | SB7 | SB8 |
| | 1 | 2 | 4 | 8 | 16 | N0 | N1 | N2 | N3 | N4 | 32 | 64 | P |
| | | | | | | T0 | T1 | T2 | T3 | T4 | | | |
| EC | 1 | 0 | 1 | 0 | 1 | X | 1 | 1 | 0 | 1 | 0 | 0 | 1 |

METHOD OF ADDRESSING A PLASMA DISPLAY PANEL

This application claims the benefit under 35 U.S.C. §365 of International Application PCT/EP00/04512, filed May 18, 2000, which claims the benefit of French Patent Application No. 99/07095, filed Jun. 4, 1999.

The invention relates to a method of addressing a plasma display panel. More particularly, the invention relates to a type of panel with separate addressing and sustaining.

Plasma display panels, called hereafter PDPs, are flat-type display screens. There are two large families of PDPs, namely PDPs whose operation is of the DC type and those whose operation is of the AC type. In general, PDPs comprise two insulating tiles (or substrates), each carrying one or more arrays of electrodes and defining between them a space filled with gas. The tiles are joined together so as to define intersections between the electrodes of the said arrays. Each electrode intersection defines an elementary cell to which a gas space corresponds, which gas space is partially bounded by barriers and in which an electrical discharge occurs when the cell is activated. The electrical discharge causes an emission of UV rays in the elementary cell and phosphors deposited on the walls of the cell convert the UV rays into visible light.

In the case of AC-type PDPs, there are two types of cell architecture, one called a matrix architecture and the other called a coplanar architecture. Although these structures are different, the operation of an elementary cell is substantially the same. Each cell may be in the ignited or "on" state or in the extinguished or "off" state. A cell may be maintained in one of these states by sending a succession of pulses, called sustain pulses, throughout the duration over which it is desired to maintain this state. A cell is turned on, or addressed, by sending a larger pulse, usually called an address pulse. A cell is turned off, or erased, by nullifying the charges within the cell using a damped discharge. To obtain various grey levels, use is made of the eye's integration phenomenon by modulating the durations of the on and off states using subscans, or subframes, over the duration of display of an image.

In order to be able to achieve temporal ignition modulation of each elementary cell, two so-called addressing modes are mainly used. A first addressing mode, called "addressing while displaying", consists in addressing each row of cells while sustaining the other rows of cells, the addressing taking place row by row in a shifted manner. A second addressing mode, called "addressing and display separation", consists in addressing, sustaining and erasing all of the cells of the panel during three separate periods. For more details concerning these two addressing modes, a person skilled in the art may, for example, refer to U.S. Pat. Nos. 5,420,602 and 5,446,344.

FIG. 1 shows the basic time division of the "addressing and display separation" mode for displaying an image. The total display time $T_{tot}$ of the image is 16.6 or 20 ms, depending on the country. During the display time, eight subscans SB1 to SB8 are effected so as to allow 256 grey levels per cell, each subscan making it possible for an elementary cell to be "on" or "off" for an illumination time Tec which is a multiple of a value To. Hereafter, reference will be made to an illumination weight p, where p corresponds to an integer such that Tec=p.To. The total duration of a subscan comprises an erasure time Tef, an address time Ta and the illumination time Tec specific to each subscan. The address time Ta can also be divided into n times an elementary time Tae, which corresponds to the addressing of one row. Since the sum of the illumination times Tec needed for a maximum grey level is equal to the maximum illumination time $T_{max}$, we have the following equation: $T_{tot}$=m.(Tef+n.Tae)+$T_{max}$, in which m represents the number of subscans. FIG. 1 corresponds to a binary decomposition of the illumination time. This binary representation has a number of drawbacks. The problem of contouring was identified a long time ago.

The contouring problem stems from the proximity of two areas whose grey levels are very close but whose illumination times are decorrelated. The worst case corresponds to a transition between the levels 127 and 128. This is because the grey level 127 corresponds to an illumination for the first seven subscans SB1 to SB7, while the level 128 corresponds to the illumination of the eighth subscan SB8. Two areas of the screen placed one beside the other, having the levels 127 and 128, are never illuminated at the same time. When the image is static and the observer's eyes do not move over the screen, temporal integration takes place relatively well and two areas with relatively close grey levels are seen. On the other hand, when the two areas move over the screen, the integration time slot changes with screen area and is shifted from one area to another for a certain number of cells. The shift in the eye's integration time slot from an area of level 127 to an area of 128 has the effect of integrating that the cells are off over the period of one frame, which results in the appearance of a dark contour of the area. Conversely, shifting the eye's integration time slot from an area of level 128 to an area of level 127 has the effect of integrating that the cells are lit to the maximum over the duration of one frame, which results in the appearance of a light contour of the area (which is less perceptible than the dark area). This phenomenon is accentuated when the display works with pixels consisting of three (red, green and blue) elementary cells, since the contouring may be coloured.

The phenomenon explained occurs at all level transitions where the switched weights are completely, or largely completely, different. Switchings of high weight are more annoying than switchings of low weight because of their magnitude. The resulting effect may be perceptible to a greater or lesser extent depending on the switched weights and on their positions. Thus, the contouring effect may also occur with levels that are quite far apart (for example 63–128, but it is much less shocking for the eye as it then corresponds to a very visible level (or colour) transition.

To remedy is contouring problem, several solutions have been employed. One solution consists in "breaking up" the high weights, which means adding subscans. Only the total image display time $T_{tot}$=m.(Tef+n.Tae)+$T_{max}$ remains fixed, which results in a reduction in the time $T_{max}$ (since Tef and Tae are incompressible time periods) and therefore in a reduction in the maximum brightness of the screen. It is possible to use up to 10 subscans, while still having correct brightness. With 10 subscans, the maximum illumination time $T_{max}$ is, currently, 30% of the total time, while the erasure and address time is of the order of 70%. FIG. 2 represents an example of addressing using 10 subscans SB1 to SB10, in which the high weights are broken up into two.

In order to reduce the large transitions and increase the number of subscans, without reducing the brightness of the screen, one technique consists in simultaneously scanning two successive rows for certain illumination values. The following equation can therefore be written: $T_{tot}$+$m_1$.(Tef+n.Tae)+$m_2$.(Tef+Tae.n/2)+$T_{max}$. Since the erasure time Tef is negligible compared with n.Tae, the following equivalence may be written: $T_{tot}$≅m($m_1$+$m_2$/2).(Tef+n.Tae)+$T_{max}$. These simultaneous subscans reduce the address time by two and thus make it possible to add additional subscans without reducing $T_{max}$. FIG. 3 shows an example of addressing with 11 subscans S1 to S11, the subscans S1 and S2 of which, corresponding to the shortest illumination times, are carried out on two rows at the same time so as to obtain an overall address time for these two subscans which is equal to the address time of a single subscan. If subscans common to two successive rows are carried out for the illumination weights 1, 2, 4 and 8, it is possible to obtain 12 subscans so as to eliminate the transitions of weight 64. However, the problem with this solution is the loss of resolution due to the simultaneous scanning of two rows.

With regard to the principle of subscans scanning two rows at the same time, one solution consists in the use of encoding with a rotating code or with multiple representation. FIG. 4 illustrates encoding with a rotating code using twelve subscans S1 to S12 with which the following illumination weights are associated: 1, 2, 4, 6, 10, 14, 18, 24, 32, 40, 48 and 56. One effect of the rotating code is to soften the switchings of high weight by reducing the number of switched weights during the switching of a high weight. To obtain the twelve subscans, a simultaneous scan of two rows is performed for the weights 2, 6, 14 and 24. Such a code furthermore allows multiple representation of the numbers: 34=32+2=24+10=24+6+4=18+14+2= etc. This multiple representation of the numbers makes it possible to code the grey levels present on the two scanned rows at the same time so that the weights 2, 6, 14 and 24 are identical. A person skilled in the art may refer to European Patent Application No. 0,874,349 (corresponding to U.S. patent application Ser. No. 09/061,419) for farther details about this technique. However, the effect of softening a switching of a high weight is reduced by the multiple coding which allows the number of subscans to be increased. In addition, the problem of loss of resolution remains since it is not always possible to have identical weights over the weights scanned simultaneously.

The invention proposes a novel scanning technique aimed at reducing the phenomenon of contouring. The scanning technique of the invention consists in adding at least one redundant subscan. The purpose of the redundant subscan is to place an additional, privileged, illumination time. The redundant subscan thus introduced makes it possible to have a quasi-steady illumination time independent of the grey level and therefore to minimize the effects of high-weight switching.

The subject of the invention is a method of displaying a video image on a display device during a display period, the said device comprising a plurality of cells arranged in rows and columns, in which method, during the display period:

each of the cells is illuminated in total for a time of between zero and a maximum display time corresponding to the maximum brightness of a cell for a given brightness setting;

single subscans are carried out so that the cells are "on" or "off" during a period specific to each of the said subscans;

at least one redundant subscan is carried out per group of rows so that the cells are "on" or "off" during a period specific to the said subscan; and the sum of the periods specific to each of the single subscans and of the periods specific to the redundant subscan is greater than the maximum display time.

The invention will be more clearly understood and further features and advantages will appear on reading the description which follows, the description referring to the appended drawings in which.

For illustration purposes, the subscan time division makes use of significant proportions which do not correspond to an exact linear scale.

Figure 1:
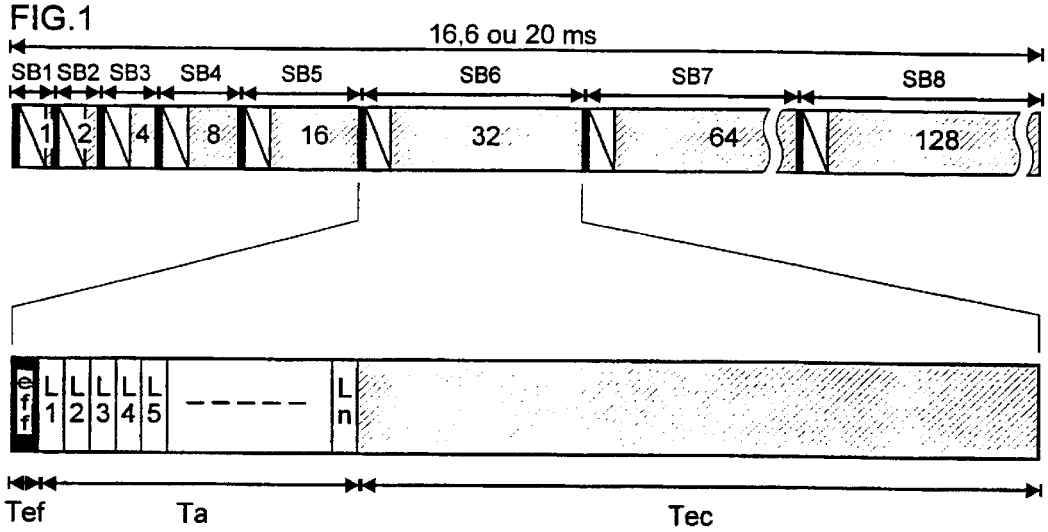
FIGS. 1 to 4 show subscan time divisions during the display of an image according to the prior art.
Figure 2:
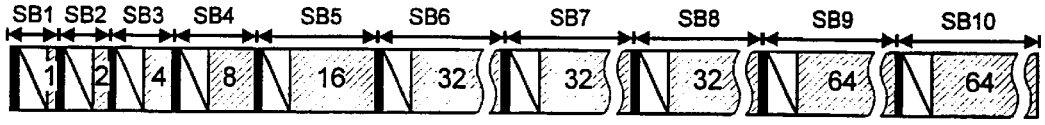
Figure 3:
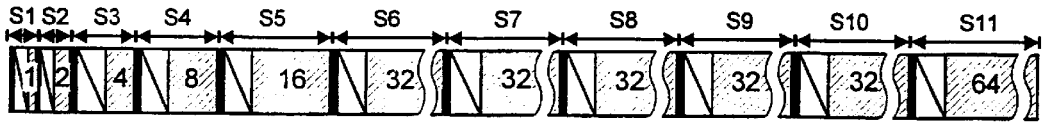
Figure 4:
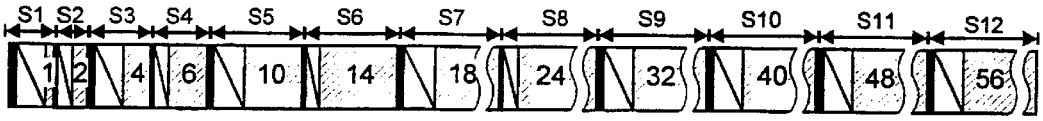
Figure 5:
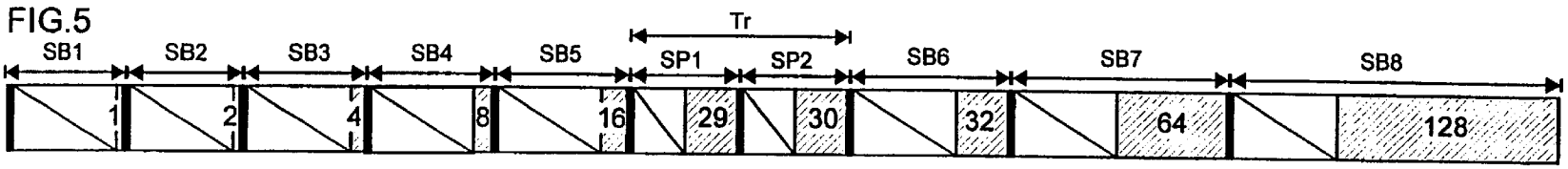
FIGS. 5 to 8 show subscan time divisions during the display of an image according to the invention.

FIG. 5 shows the subscans carried out in order to display an image on a PDP according to the invention. Eight subscans SB1 to SB8 ensure binary coding of the 256 grey levels (0 to 255) of each of the cells of the PDP. In the preferred example, it was chosen to dedicate 30% of the image display time to the actual displaying of the image, hence, in order to perform eight complete panel-addressing steps, only 56% of the image display time is used. The 14% of the image display time not used by the eight subscans constitutes a redundant time Tr. Redundant time Tr allows redundant subscans SP1 and SP2 to be carried out.

The redundant subscans SP1 and SP2 are used first and foremost to create a steady illumination period with respect to the display period. When the redundant subscans SP1 and SP2 are used for a cell, the weight of the redundant subscans SP1 and SP2 is calculated from the level to be coded over the other subscans SB1 to SB8. The steady illumination area must be present in both areas so that the contouring effect is reduced. The redundant subscans should also be placed approximately in the middle of the image display period so that the unilluminated period is reduced. The total weight of the redundant subscans SP1 and SP2 must also have the highest possible value in order to minimize as far as possible the contouring effect.

As a person skilled in the art may notice, the redundant time Tr corresponds to two complete row-addressing steps in the PDP. If one scan per row is carried out, a single redundant subscan is possible, hence the weight associated with this redundant subscan is defined for the entire PDP. In order to produce a contouring-compensation effect, the steady illumination should be present for a maximum area, while being as large as possible. However, in order to minimize the contouring effect, the weight of the redundant subscan should also be less than the grey level where the contouring effect may occur. It is therefore preferred to use at least two subscans so as to have greater operating flexibility.

In order to obtain several subscans without reducing the brightness of the PDP, the invention proposes to address the rows as a group of rows. FIG. 5 produces its two subscans with one addressing step per group of two rows. The addressing per group of two rows makes it possible to reduce the address time by half, thereby making it possible, for example, to have two subscans SP1 and SP2 of respective weights 29 and 30.

Figure 6:
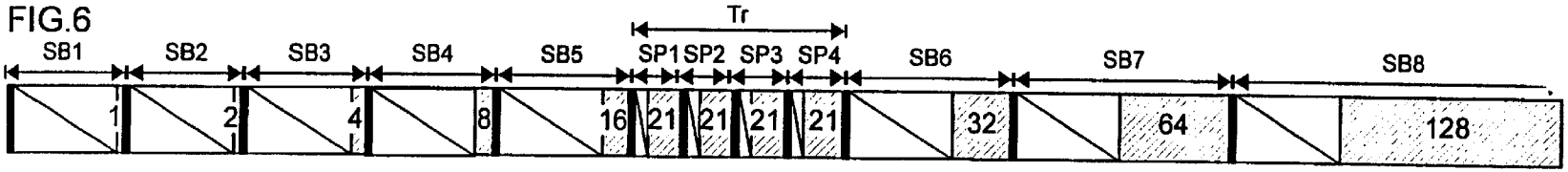

In order to increase the weight of the redundant scans, it is possible to address larger groups of rows, for example groups of eight rows as in FIG. 6. A drawback in addressing groups of eight rows is that, over the eight rows addressed simultaneously, the probability of having cells whose grey levels are very different is higher than with one addressing step per group of two rows. To do this, a larger number of redundant subscans SP1 to SP4 is carried out. To increase the probability of simultaneous illumination, it is possible to perform addressing steps over several groups of rows. By way of example, four groups of consecutive rows, respectively associated with each of the redundant subscans SP1 to SP4, may be produced, namely a first group combining rows $8n$ to $8n+7$, a second group combining rows $8n-2$ to $8n+5$, a third group combining rows $8n-4$ to $8n+3$ and a fourth group combining rows $8n-6$ to $8n+1$.

For certain PDP structures, the cells placed along the same column do not necessary have the same colour. It is then necessary to make groups of correlated rows. The expression "correlated rows" should be understood to mean those rows whose cells placed on the same column have the same colour (red, green or blue). In the case of PDPs with a staggered cell structure, the correlated rows correspond to interlaced groups of even and odd rows.

Figure 7:
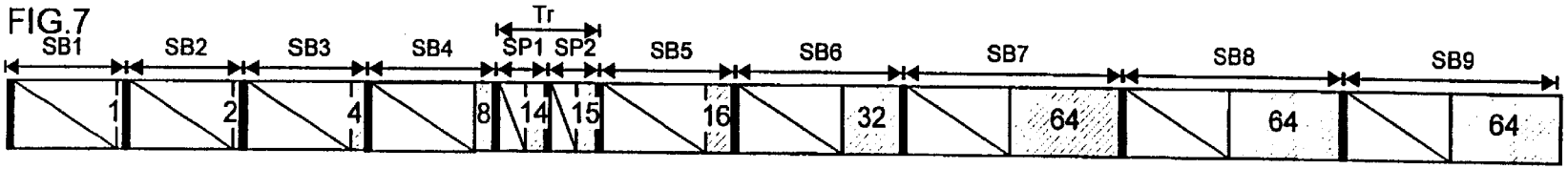

FIG. 7 corresponds to a variant of the invention, which uses nine subscans SB1 to SB9 with the weigh 128 broken up into two weights 64. The redundant time Tr now corresponds only to 7% of the image display time. However, there is no longer any switching of weight 128, and hence the attenuation may be of shorter duration. For example, it is possible to carry out two subscans of weights 14 and 15 by performing one addressing step per group of four rows.

Figure 8:
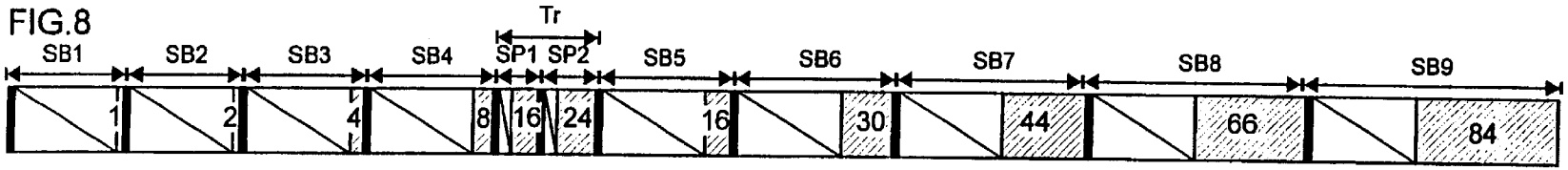

FIG. 8 corresponds to a variant which uses a rotating code comprising nine subscans SB1 to SB9. The redundant time Tr corresponds to 7% of the image display time, during which two redundant subscans SP1 and SP2 of respective weights 16 and 24, are carried out by addressing groups of eight rows.

An image may be of greater or lesser brightness. In addition, depending on the images, it may be of greater or lesser advantage to group by eight or by sixteen. Furthermore, according to the invention, it is not necessary to have to code, over each image, 255 grey levels in addition to the redundant grey levels. A fixed coding does not allow the coding to be optimized for each image. Preferably, a dynamic coding which depends on each image is used. In other words, the illumination periods specific to each redundant subscan are calculated for each image. The embodiment which follows represents an example of dynamic coding which takes into account the brightness of the image.

Figures 9, 10:
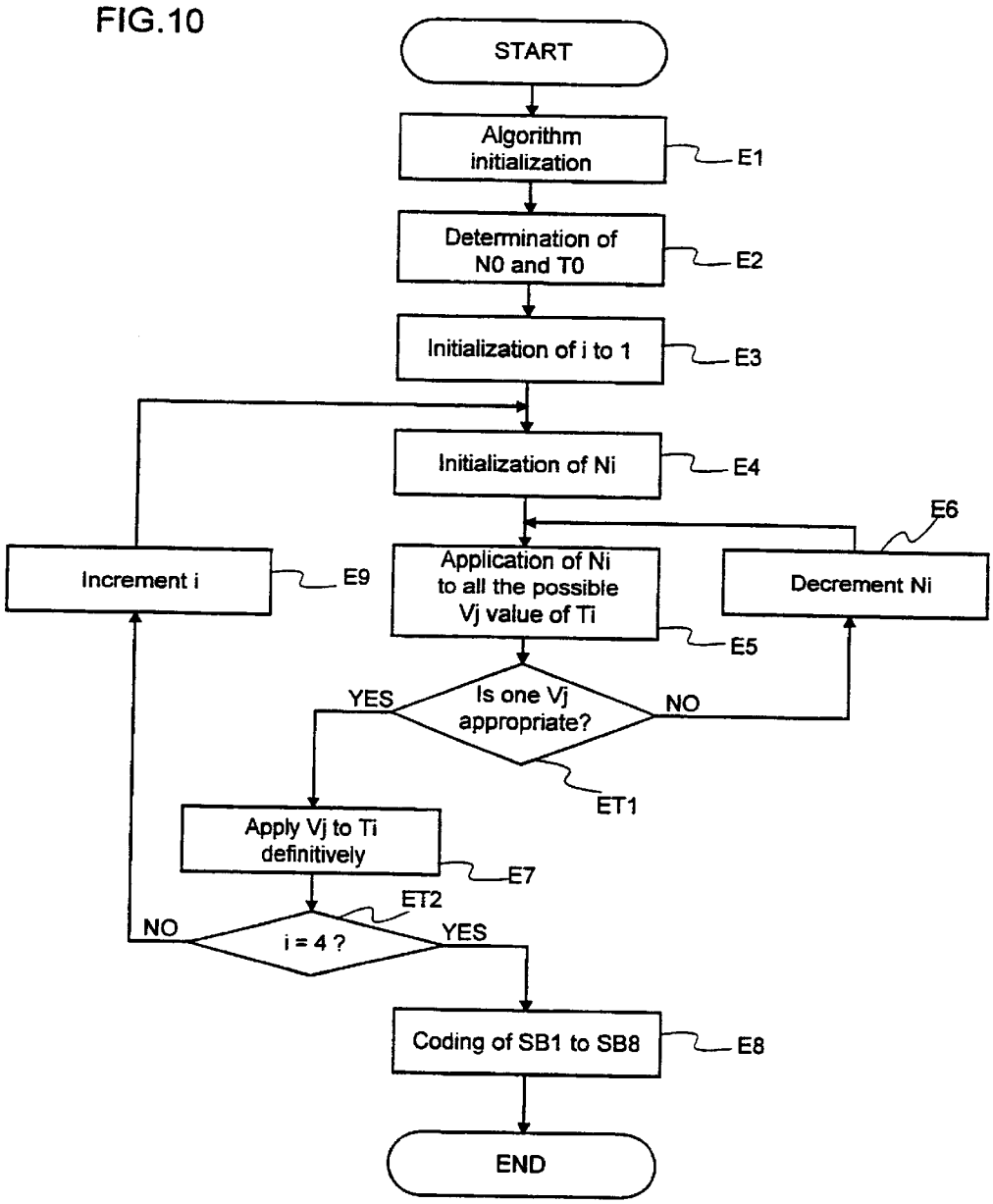
FIG. 9 shows a subscan dynamic coding table according to the invention.
FIG. 10 shows a dynamic coding algorithm according to the invention.

FIG. 9 shows, on the one hand, a coding table CT and, on the other hand, a coding example CE for one cell. The coding table includes, for each subscan SB1 to SB8 and each redundant subscan SP0 to SP4, the illumination weight associated with the said subscans. The illumination weights are fixed for seven subscans SB1 to SB7. The subscan SB8, which corresponds to the high-weight subscan has an illumination weight P which changes for each image. The illumination weights N0 to N4 of the redundant subscans SP0 to SP4 are also defined for each image. Scanning types T0 to T4 are associated with each redundant subscan SP0 to SP4 in order to indicate how the said subscan SP0 to SP4 is carried out.

Among the redundant subscans SP0 to SP4 may be distinguished the subscan SP0 which corresponds to simultaneous scanning of all the rows of the screen. The type T0, associated with the subscan SP0, takes only two values, one indicating that the subscan SP0 has been carried out and the other indicating that the subscan SP0 has not been carried out. The weight N0 corresponds to an illumination period common to all the cells of the PDP. The address time for this subscan SP0 is reduced to a minimum period (erasure time+address time for one row).

The redundant subscans SP1 to SP4 correspond, for example, to the scanning of eight or sixteen rows. Types T1 to T4 may, for example, take one of the following seven values V1 to V7:

V1: no subscan;

V2: addressing per group of 16 rows, from rows 16*n* to 16*n*+15;

V3: addressing per group of 16 rows, from rows 16*n*−8 to 16*n*+7;

V4: addressing per group of 8 rows, from rows 8*n* to 8*n*+7;

V5: addressing per group of 8 rows, from rows 8*n*−2 to 8*n*+5;

V6: addressing per group of 8 rows, from rows 8*n*−4 to 8*n*+3;

V7: addressing per group of 8 rows, from rows 8*n*−6 to 8*n*+1.

The types T1 to T4 and the weights N1 to N4 may be fixed in various ways. Thus, it is possible to use various algorithms of greater or lesser complexity and of greater or lesser effectiveness. However, the effectiveness of the algorithm may require very high-performance computation means or means which are too expensive to be able to integrate into a PDP. The algorithm example which follows, while still being relatively simple, does require a certain computing power and may be simplified by adjusting various parameters.

The algorithm starts as soon as an image to be displayed is stored in a first memory. A first step E1 initializes the values of the illumination weight P and of the remaining redundant time Trr which are set, initially, equal to 128 and equal to the redundant time Tr, respectively. A relative value of the redundant time Tr equal, for example, to 14% of the image display time may be used. To obtain a redundant time that remains a maximum, the maximum value $E_{max}$, which corresponds to a maximum illumination of the PDP may be used. To do this, the illumination level $Ec_{max}$ of the most illuminated cell of the PDP is determined and the difference between the maximum illumination level $E_{max}$ and the illumination level $Ec_{max}$ is determined so as to obtain the result $R=E_{max}-Ec_{max}$. The result R makes it possible to correct the weight, P=P−R and the remaining redundant time Trr=Trr+R×0.118%.

Next, a second step E2 determines whether or not a subscan SP0 is to be carried out. To do this, it is necessary to determine which is the illumination level, $Ec_{min}$, of the least illuminated cell of the PDP. If the illumination level $Ec_{min}$ is equal to zero, the type T0 is given the value which indicates that the subscan SP0 is not carried out. If the illumination level $Ec_{min}$ is not equal to zero, then the type T0 is given the value which indicates that the subscan SP0 is carried out; the weight $N0=Ec_{min}$ is set; the illumination levels of all the cells are corrected by subtracting the weight N0; the weight is corrected, $P=P-Ec_{min}$; the remaining redundant time is corrected, Trr=Trr−0.05%.

A third step E3 initializes an index i to 1. The index i indexes the type Ti and the weight Ni which are associated with the subscan SPi for i varying from 1 to 4.

A fourth step E4 initializes the weight Ni. The weight Ni may be initialized, for example, to 50 or to a value equal to (Trr−0.95)/0.118 (rounded to the lower integer) if the said value is less than 50.

A fifth step E5 consists in testing all the possible scanning types—six in our example—so as to measure the effectiveness of all the scanning types for the given weight Ni. The test of a scanning type consists, on the one hand, in determining the number of cells affected by the scanning type and, on the other hand, in determining which is the maximum level that will be distributed over the subscans SB1 to SB8.

After the fifth step E5, a first test step ET1 is carried out. The first test step ET1 consists, on the one hand, in determining if at least one of the scans is appropriate and, on the other hand, in choosing which scanning type V1 to V7 will actually be used. If no scanning type V1 to V7 is appropriate, a sixth step E6 is carried out. If a scan is appropriate, then a seventh step E7 is carried out.

The first test step ET1 performs a succession of comparisons. Ni is compared with zero. If Ni is zero, then the type Ti takes the value V1 so that no subscan is carried out. If none of the scanning types makes it possible either to decrement the maximum level, which will be distributed over the subscans SB1 to SB8, or to assign a minimum cell number (for example 512), and if Ni is above a threshold (for example 20) then the sixth step E6 is carried out. If at least one of the scanning types makes it possible to decrement the maximum level which will be distributed over the subscans SB1 to SB8, or to assign a minimum cell number (for example 512), or if Ni is below a threshold (for example 20), the scanning type Vj which corresponds to the maximum of the simultaneously illuminated cells is then determined and the type Ti takes the corresponding value Vj, and then the seventh step E7 is carried out.

The sixth step E6 decrements Ni, for example by a step of 10. Next, the fifth step E5 is carried out in order to establish which scanning type V1 to V7 is the most appropriate to this new value of Ni.

The seventh step E7 serves to apply, in a definitive manner, the type Vj to the redundant subscan SPi. For each cell, a bit, corresponding to the redundant subscan SPi, is assigned to zero or to one, depending on whether the cell is illuminated or not. For all the illuminated cells, Ni is subtracted from the illumination level of the said cell. The illumination level $Ec_{max}$ of the most illuminated cell is determined. If $Ec_{max}$ is greater than 127, the reduction weight $Pr=P+127-Ec_{max}$ is determined. Next, the weight is corrected, P=P−Pr, and the remaining redundant time is corrected, Trr=Trr−Tj (Ni−Pr)×0.118%. Tj, corresponding to the scanning address time associated with the value Vj, for example 0.5% in the case of scanning per sixteen rows and 0.95% in the case of scanning per eight rows.

After the seventh step E7, a second test step ET2 is carried out. The second test step ET2 consists in checking whether all the redundant subscans SP1 to SP4 have been defined. The index i is tested, for example. If i=4, then an eighth step E8 is carried out, otherwise a ninth step E9 is carried out.

The eighth step E8 consists in coding the remaining illumination level of each cell with the aid of the subscans SB1 to SB8. It is possible, for example, to carry out a method of the prior art. The coding of the illumination level is then complete and it then remains to display the image using the coding made.

The ninth step E9 increments the index i by one unit. After this incrementation, the fourth step E4 is again carried out.

Although such an algorithm can continually carry out redundant subscans that differ from one image to another, the contouring effect is reduced by the preferential illumination of the cells during the redundant time Tr. This is because the contouring effect occurs over areas of a minimum size which will be illuminated simultaneously during the redundant time that always starts at the same moment.

As will have been understood by a person skilled in the art, many variants of this algorithm are possible. It is recommended to match the complexity of the algorithm to the available computing means, especially for cost reasons. The number of scanning types as well as the various parameters used are to be defined depending on the number of computations that can be made during the period that an image is displayed, something which essentially depends on the number of computing units used for the coding.

In our example, we vary the weight P of the subscan SB8 according to the maximum illumination periods of the cells after the redundant subscans have been coded. It is also possible to vary the illumination weights of the other subscans SB1 to SB7. It is also possible not to vary this period, so as to reduce the complexity of the system.

In addition, in our example, two effectiveness criteria are used to determine the chosen value of Ni. It goes without saying that other effectiveness criteria may be used, by themselves or in combination.

Moreover, the time values, expressed as a percentage of the image display time, correspond to a screen having 512 rows. It goes without saying that these relative periods may be modified depending on the number of rows that the PDP may have, on the maximum illumination period chosen and on the erasure period incorporated in our example into the address time.

In thus, the use of the disclosed algorithm is not limited to PDP application. The algorithm can be used in all display device comprising display cells working in a two state (on or off) mode.

What is claimed is:

1. Method of displaying a video image on a display device during a display period, the said device comprising a plurality of cells arranged in rows and columns, in which method, during the display period:

each of the cells is illuminated in total for a time of between zero and a maximum display time corresponding to the maximum brightness of a cell for a given brightness setting;

single subscans are carried out so that the cells are "on" or "off" during a period specific to each of said subscans;

wherein:

at least one redundant subscan is carried out per group of rows so that the cells are "on" or "off" during a period specific to said subscan, the redundant subscans being used first and foremost to create a steady illumination period; and the sum of the periods specific to each of the single subscans and of the period specific to the redundant subscan is greater than the maximum display time.

2. Method according to claim 1, wherein the single subscans perform a row-by-row addressing step.

3. Method according to claim 1, wherein the group of rows is a group of consecutive rows.

4. Method according to claim 1, wherein the group of rows is a group of correlated rows.

5. Method according to claim 1, wherein at least two redundant subscans perform addressing steps per group of rows within at least two different groupings.

6. Method according to claim 1, wherein the illumination period specific to each of the at least one redundant subscan is computed for each image.

7. Method according to claim 6, wherein when a non-zero minimum illumination level exists over the entire display device, a subscan common to all the rows, the illumination period of which corresponds to the minimum illumination level, is carried out.

8. Method according to claim 7, wherein the sum of the illumination periods associated with the single subscans corresponds to a variable period computed for each image, depending on the redundant subscans.

9. Method according to claim 1, wherein the display device is a plasma display panel.

* * * * *